United States Patent [19]

Mehta et al.

[11] Patent Number: 4,856,909

[45] Date of Patent: Aug. 15, 1989

[54] PHARMACOLOGICAL DISSOLUTION METHOD AND APPARATUS

[75] Inventors: Gunvant N. Mehta, Bensalem; Dennis J. Wertan, Philadelphia; Wayne M. Grim, Doylestown, all of Pa.

[73] Assignee: Rorer Pharmaceutical Corporation, Fort Washington, Pa.

[21] Appl. No.: 877,146

[22] Filed: Jun. 23, 1986

[51] Int. Cl.[4] ..... B01F 1/00

[52] U.S. Cl. ..... 366/208; 366/142; 366/213; 366/234; 366/349; 73/866; 422/277

[58] Field of Search ..... 366/348, 349, 241, 219, 366/220, 342, 343, 344, 129, 130, 208, 213–215, 209, 142, 234; 99/302 C; 422/269, 270, 274, 277; 118/19; 73/53, 866

[56] References Cited

U.S. PATENT DOCUMENTS

| | | | |
|---|---|---|---|
| 364,566 | 6/1887 | Avers et al. | 422/270 |
| 1,430,511 | 9/1922 | Labadie | 366/130 |
| 1,689,103 | 10/1928 | Bendixen | 366/197 |
| 1,982,847 | 12/1934 | Werner | 366/213 |
| 1,984,047 | 12/1934 | Thieme | 99/280 |
| 2,104,456 | 1/1938 | Friedman | 366/213 |
| 2,141,713 | 12/1938 | Hensler et al. | 366/197 |
| 2,191,739 | 2/1940 | Bean | 366/208 |
| 2,268,253 | 12/1941 | Hill et al. | 15/250.22 |
| 3,572,648 | 3/1971 | Hanson | 366/220 |
| 3,742,190 | 6/1973 | Giani et al. | 73/866 |
| 3,802,272 | 4/1974 | Bischoff et al. | 366/241 |
| 3,904,178 | 9/1975 | Scott et al. | 366/213 |

OTHER PUBLICATIONS

"Variation on the USP-NF Rotating Basket Dissolution Apparatus and a New Device for Dissolution Rate Studies of Solid Dosage Forms"; Author: Haringer et al; Source: Journal of Pharmaceutical Sciences; Date: Jan. 1973; pp. 130–132.

*Primary Examiner*—Harvey C. Hornsby
*Assistant Examiner*—Joseph S. Machuga

[57] ABSTRACT

Standardized tests of the dissolution rates of pharmacologic dosage units such as salicylic acid tablets, for example, are conducted by placing the dosage unit in a liquid-permeable cylindrical wire basket and rotating the basket in the solvent about two different axes, preferably one vertical axis and one horizontal axis. The apparatus comprises an outer vertical tube to which the basket is mounted off center from the vertical axis of the tube so that it orbits around the vertical axis when the vertical outer tube is rotated; the basket is mounted on a horizontal shaft which can rotate about its horizontal axis. An inner shaft extends vertically through the outer vertical shaft, and bevel gears are provided between the horizontal shaft and the inner vertical shaft so that relative rotation of the upper ends of the inner and outer vertical shafts with respect to each other about their axes causes the basket to rotate about the horizontal shaft axis. By holding the inner shaft stationary and rotating the outer shaft, the desired two-axis motion of the basket is produced.

10 Claims, 3 Drawing Sheets

Fig. 2.
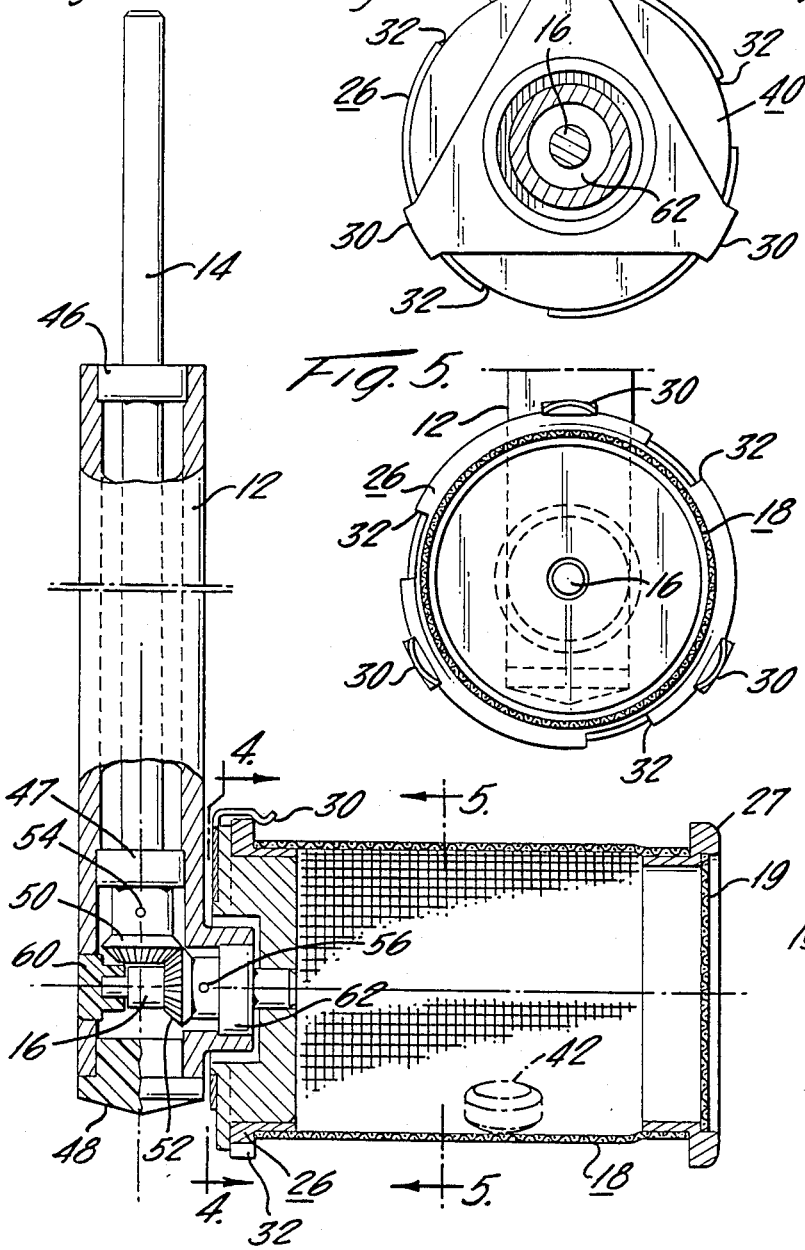
Fig. 4.
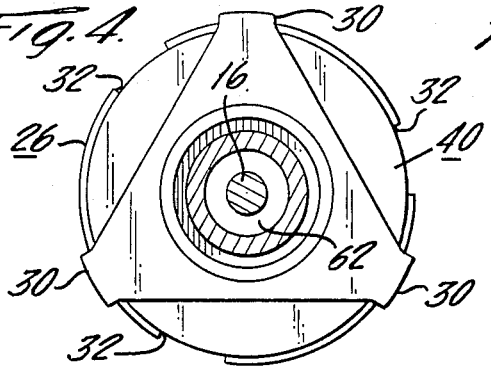
Fig. 5.
Fig. 3.
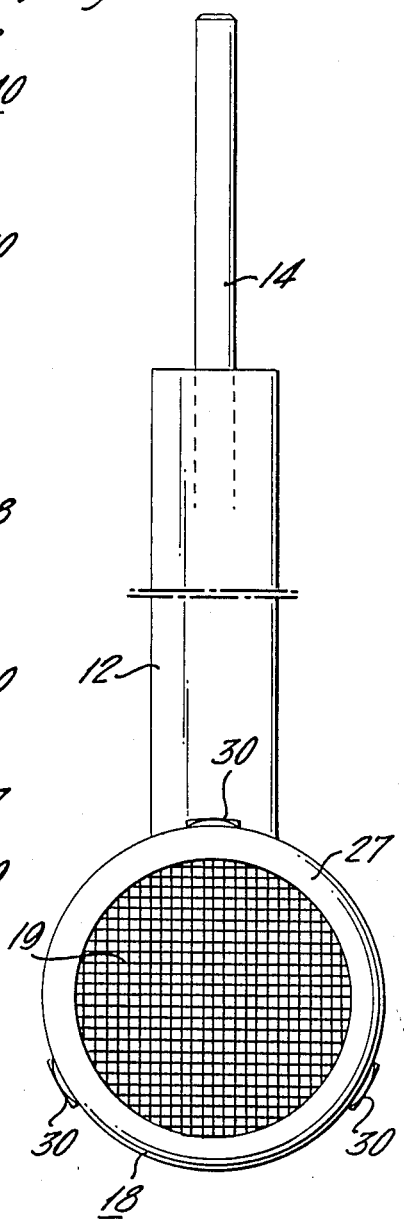
Fig. 6.
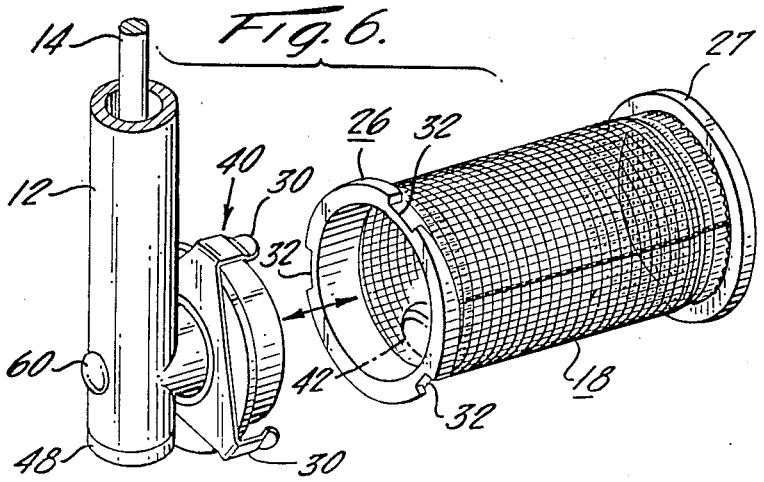

PHARMACOLOGICAL DISSOLUTION METHOD AND APPARATUS

BACKGROUND OF THE INVENTION

It is well known that the dissolution rate of an orally ingested drug in the human alimentary canal can greatly effect the physiologic effect and biological activity of the drug, particularly where the rate of dissolution is slower than the rate of absorption of the drug in the body, i.e. the absorption of the drug is dissolution rate-limited. In cases other than dissolution rate-limited absorption, the rate of dissolution is not so important in this respect, since the body is then receiving the dissolved drug as fast as it can use it.

Since the rate of dissolution of the drug is important, it has also become important to be able to measure this rate accurately, reproducibly and, in a manner which correlates with dissolution of the drug in the body cavity in which it is normally to be dissolved during treatment of a patient. The latter property is commonly referred to as correlation between in vitro and in vivo dissolution.

Flexibility of the apparatus and method are also significant, in that they are preferably applicable to a wide range of drug products. Simplicity is also highly desirable, since the mechanism should be relatively easy to operate and not require an undue amount of time in setting up to perform the test. It is also desirable, if possible, to provide an apparatus and method which are compatible with automation, at least in some uses of the apparatus.

Such dissolution methods and apparatus may be important in assuring that drug products meet certain requirements of the Federal Drug Administration (FDA) with regard to rate of dissolution. For example, if a drug producer advertises that a drug unit (pill, pellet, capsule, etc.) of his product contains Q grams of active ingredient, then the FDA may, for example, require that 75% of the stated amount Q be dissolved within 30 minutes of ingestion. Obviously, this is very difficult or impossible to measure in vivo, for example in a patient's stomach, and therefore some universally accepted test equipment and procedure must be provided which is accepted as correlating sufficiently well with the in vivo condition to provide a useful representation of actual in vivo dissolution rates.

For over twenty years a large variety of methods and apparatus have been proposed and tested for accomplishing such standardized measurement of dissolution rate. In general, these involve methods of agitating a solvent bath in which the drug dosage object is placed; lacking such agitation, the dissolved material will move away from the surface of the underlying dosage object only very slowly, thus maintaining a high concentration of the dissolved drug adjacent the surface of the object and thereby inhibiting the rate of further dissolution. The dissolution medium or solvent usually consist of purified water, USP, or a specific buffer system, or a specific mixture of solvents. If the dosage unit were stationary in vivo, it would not be necessary to provide agitation in the test apparatus. However, obviously the dosage object will be subjected to substantial agitation and motion in vivo, and to correlate with the in vivo conditions the in vitro tests should provide some kind of equivalent relative motion between the dosage object and the solvent bath.

The general type of equipment which has been used in the past comprises a container in which the solvent material (dissolution medium) is placed and in which the drug dosage unit is immersed, while some type of agitation is applied. Samples of the solvent are then taken at appropriate times and positions in the bath and the concentrations of the drug present in the solvent determined, as by spectrophotometer measurements. From these results, the percentage of drug dissolved at any given time is calculated. Currently, the FDA has issued monographs which specify the acceptable limits on the range of results obtained in such measurements in specified types of standard test equipment, and at least in some cases specify also the maximum permitted standard deviation for the results of a large number of such tests on any given equipment with a specified procedure.

In some prior-art apparatus for conducting such tests, the dosage unit is placed in a solvent bath in a container which may have a flat or a curved bottom, and the liquid agitated as by a rotating paddle, for example. In order to constrain the geometric position of the dosage unit during agitation, in some cases the dosage unit was placed in a suitable small porous basket; this is particularly desirable where the dosage unit may float, as in the case of certain capsules. Such a basket arrangement has been utilized with an adjacent rotating paddle to provide the agitation, and in some cases the basket has been secured to a vertical rotating rod so as to rotate on the axis of the rod, or secured to a fixed arm extending at right angles to the rod, the entire basket then swinging or orbiting around the axis of the rod as the rod is rotated.

All previously proposed methods and apparatus for accomplishing such measurements of dissolution rate are subject to criticism on the grounds of failure to meet one or more of the above-identified criteria to the extent which might be desirable. Thus while they may have been acceptable for some purposes, each of them has one or more drawbacks or limitations in the respects noted.

At present, there are two standardized types of test equipment which are used for such purposes, known as USP I and USP II. USP I uses a porous wire-mesh basket of cylindrical shape which contains the dosage unit to be tested, and which is clipped to the lower end of a vertical rotating rod with its cylindrical axis coaxial with the axis of the rod. The rod and basket are rotated at a predetermined rate, and other parameters of the test apparatus and method are as specified in detail by the U.S. Government standard, namely the United States Pharmacopeia XXI, the National Formulary XVI, 1985.

In the USP II apparatus the dosage unit is allowed to sink to the bottom of the container, and the paddle rotates in a horizontal plane, driven by a vertical drive shaft located above the dosage unit, which is preferably lying on the bottom of a concave-upward lower face of the container. This standard procedure is also set forth in the above-identified standards publication.

While each of the above described USP methods and apparatus has provided usable results, it would be desirable to be able to obtain higher rates of dissolution for a given speed of rotation of the vertical shaft. For example, typically the specifications for a test of a particular dosage material using USP I or USP II will call for one-hundred revolutions per minute (RPM) of the drive shaft for the agitator, whether it rotates a paddle or a basket. This is in order to obtain agitation sufficient to produce the specified percentage of dissolution within a reasonable length of time. However, such relatively high rates of rotation introduce problems of resultant uncontrolled mechanical vibrations, which may influence the dissolution rate, as well as flow characteristics in the solvent which may be so violent as not to be accurately reproducible. In general, it is believed to be desirable to be able to produce a given rate of dissolution with as slow a speed of rotation as possible, not only from the above-described viewpoints but also from the viewpoint that the conditions thereby produced at the dosage unit would appear to correlate more closely with the relatively slow motions to which the dosage unit is typically subjected in vivo.

It is also generally important that the dosage unit, when in the process of dissolution, does not stick to its container, since otherwise all surfaces will not be equally exposed to the solvent.

Accordingly, it is an object of the present invention to provide a new and useful method and apparatus for the controlled dissolution of a pharmicalogical dosage unit.

Another object is to provide such method and apparatus in which a high rate of dissolution is obtained for a relatively low rate of rotation of the agitating system.

A further object is to provide such method and apparatus which also minimizes the possibilities that the dosage unit may stick to the receptacle in which it is contained and thus not be exposed equally on all surfaces to the solvent material.

SUMMARY OF THE INVENTION

These and other objects of the invention are achieved by the provision of an agitator apparatus and method for use in the dissolution of pharmacological dosage units in which the unit is placed in a porous basket or cage pervious to the solvent, and the basket rotated about two axis extending at an angle to each other. Preferably, one such axis is substantially vertical, and the other is substantially horizontal and therefore at right angles to the first axis. Preferably also, the basket is positioned off-axis from the vertical axis of rotation, so that it orbits about the vertical axis, while the other axis extends through the basket, preferably substantially along its geometric axis, although other arrangements of the axes may be employed instead.

Thus in the preferred embodiment of the invention the basket, mounted on an arm extending at right angles to the lower end of the vertical rotating rod, orbits around the axis of the vertical rod and at the same time rotates around its own horizonal axis.

This method and apparatus have been found to produce substantially higher rates of dissolution at a given rate of rotation about the vertical axis, particularly at revolution rates of about 50 RPM. This permits dissolution tests to be made, within reasonable lengths of time, at substantially lower rates of rotation, with attendant advantages with respect to reducing mechanical vibration and random uncontrolled motions of the solvent. The rotation of the basket about a horizontal axis also makes it much more unlikely that the dosage unit will fix itself to a particular position in the basket, since it will be tumbled in response to gravity as the basket rotates about the horizontal axis. Thus, the dosage unit will be subjected to a flow of solvent extending over substantially all of its exterior surfaces, as is desired for rapidity and reproducibility of dissolution, as well as for better correlation with in vivo dissolution.

In one preferred embodiment the rotation rates about the two axes are the same, but they may be made different if desired, and in fact their relative directions of rotation may be reversed if desired. Each type of rotation may be made completely independent of the other, and controllable to any desired rotation rate; or, the rates and relative rates of the rotations about the two axes may be determined by gearing, recognizing that different gears may be inserted into the apparatus for different applications, if desired.

BRIEF DESCRIPTION OF FIGURES

These and other objects and features of the invention will be more readily understood from a consideration of the following detailed description, taken with the accompanying drawings, in which:

FIG. 2 is an enlarged fragmentary side view, partly in section, of the lower portion of the agitating apparatus shown in FIG. 1;

FIG. 3 is an end view of the apparatus of FIG. 2;

FIG. 4 is a sectional view taken along lines 4—4 of FIG. 2;

FIG. 5 is a sectional view taken along lines 5—5 of FIG. 2;

FIG. 6 is a perspective view of the apparatus of FIG. 2; and

DETAILED DESCRIPTION OF SPECIFIC EMBODIMENTS

Figure 1:
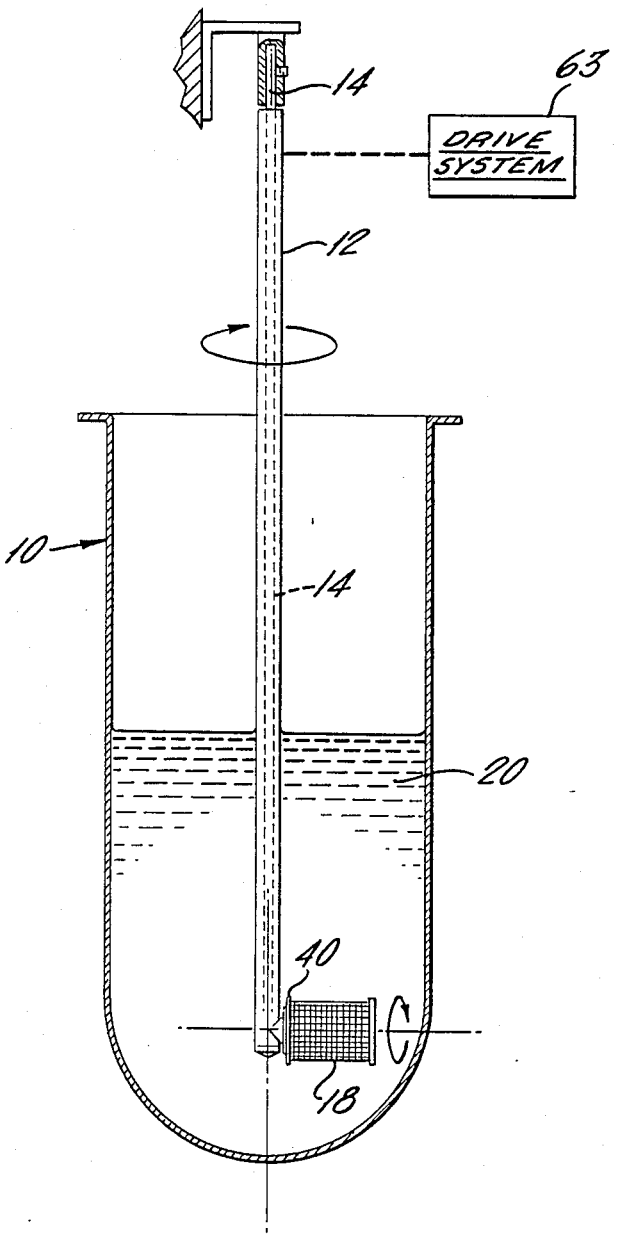
FIG. 1 is a vertical section through an apparatus constructed according to the present invention.

Referring now to the preferred embodiment of the invention shown in the drawings by way of example only, and without thereby in any way limiting the scope of the invention, in FIG. 1 there is shown a container 10 in the form of a glass beaker about 9.8 cm to 10.6 cm in inside diameter and about 16 cm to 17.5 cm in height, having a hemispherical bottom. Within it is positioned the agitator mechanism of the present invention, consisting of a hollow outer vertical drive shaft 12, an inner, coaxial vertical drive shaft 14, a horizontal drive shaft 16 (see FIG. 2) near the lower end of the vertical drive shaft and a cylindrical basket 18 having its axis coaxial with the latter horizontal drive shaft and positioned within the solvent 20. The basket may be placed about 2.5 cm above the center of the bottom of the container 10, and preferably is located substantially midway between the adjacent inner wall of the container and the axis of the drive shaft arrangement, as shown. It is possible, and contemplated within the scope of the invention, to provide fins or blades on the exterior of the basket and to mount it for free rotation on horizontal drive shaft 16, so that rotation of the basket is produced in response to its motion through the water; however, it is preferred to provide a positive drive for the rotation of the basket, as will now be described. Not shown is the usual thermostatically-controlled bath for holding the temperature of the solvent at about 37° C.

More particularly, and as shown in more detail in FIGS. 2–6, basket 18 is in the form of a horizontal cylinder of #40 stainless steel wire mesh having end rings 26,27 welded thereto. It is secured to horizontal drive shaft 16 by a chuck 40 comprising three spring clips 30, cooperating with slots such as 32 in ring 26 so that the basket can be removed by rotating it with respect to chuck 40 and then pulling it axially away from the chuck; replacement is accomplished by reversing these steps. When removed, the end of the basket 18 normally facing the chuck is open for the insertion of the dosage unit 42. The other, distal end of the cylinder is closed by wire mesh closure 19 secured to ring 27.

Inner vertical shaft 14 is supported for relative rotation with respect to outer vertical shaft 12 in top bearing 46 and in lower bearing 47. The lower end of shaft 12 is closed at its bottom by plastic plug 48.

A pair of bevel gears 50,52 are carried on the respective adjacent ends of vertical inner shaft 14 and horizontal shaft 16, and engage each other so that turning of either shaft causes the other to rotate about its axis. Pins 54 and 56 hold the gears on their respective shafts. Horizontal shaft 16 is journalled in bearings 60 and 62.

In this embodiment, the upper end of the inner vertical shaft 14 and the upper end of the outer vertical shaft 12 are controllably rotatable one with respect to the other by a conventional drive system 63 such as the Easy Lift unit made by Hanson Research of Northridge, Calif. The drive system may be controlled to rotate the shaft or shafts which it drives at any of a range of speeds, e.g. 0 to 150 RPM, and in either direction. In this example the central shaft is held fixedly and the hollow outer shaft is rotated.

More particularly, in the preferred embodiment shown in the drawings, inner shaft 14 is held fixed to a support while the outer shaft 12 is rotated. Since basket 18 is secured to outer shaft 12, it rotates orbitally about the vertical axis of shaft 12. At the same time, bevel gear 50 is fixed to the lower end of inner shaft 14 and hence remains fixed; as basket 18 orbits about shaft 12 the bevel gear 52, which orbits with the basket, "walks" around bevel gear 50 and is thereby rotated to spin to basket 18 around its horizontal cylinder axis as it orbits about shaft 12.

The basket 18 is placed as shown in FIG. 1, below the surface of the solvent 20 in beaker 10. Beaker 10 may be a 1000 ml standard thin-wall TECH GLASS beaker, and the basket is preferably located with its axis radial of the beaker and approximately centered between the axis of the vertical rotatable shafts and the adjacent inner wall of the beaker. The distance between the inside bottom of the vessel and the basket is maintained at 2.5 cm±0.2 cm during the test.

At the beginning of a dissolution test, the dosage unit is placed in the removed basket 18 shown in FIG. 6, the basket replaced in the chuck, and the unit placed in the solvent as shown, and the motor drive started immediately.

Figure 7:
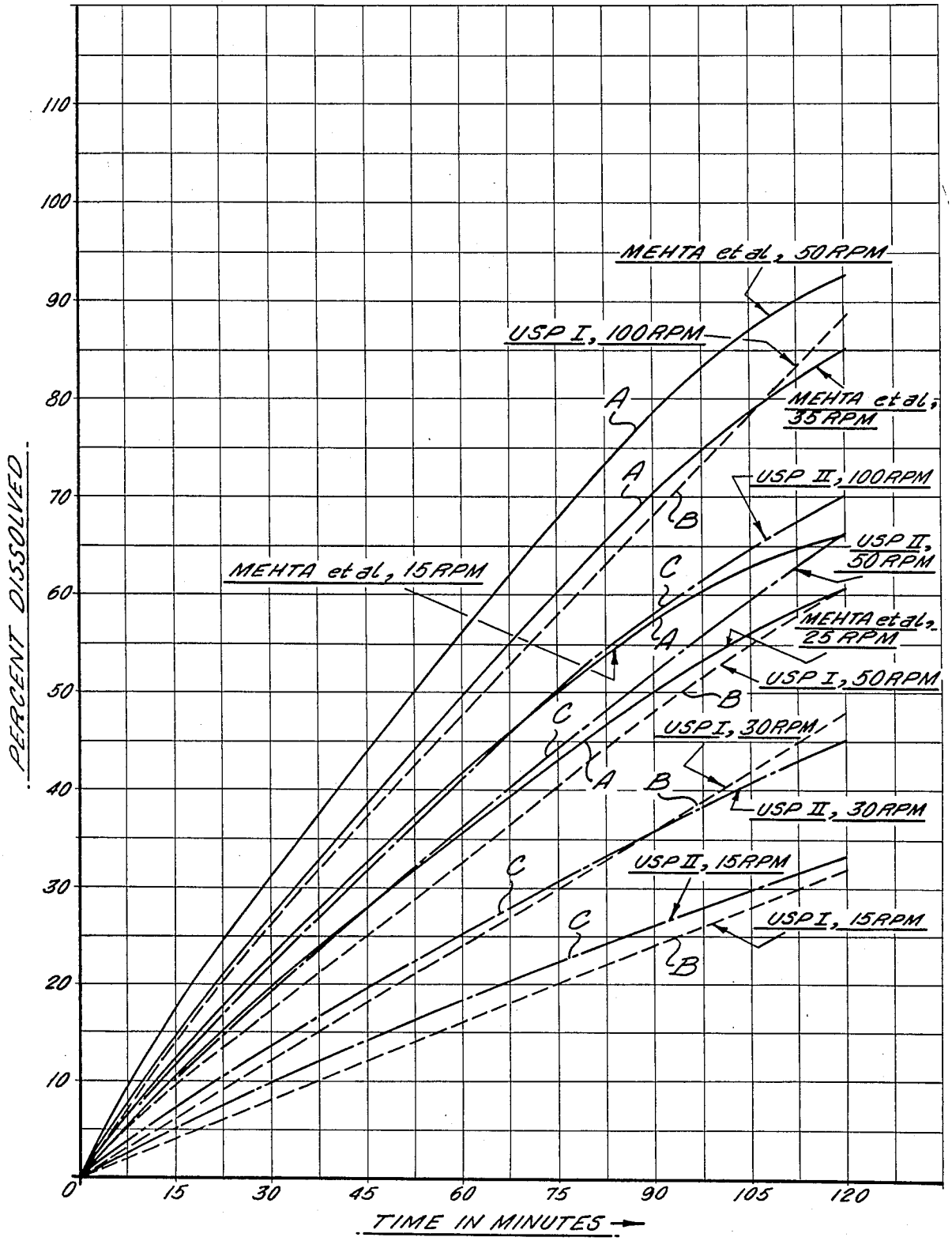
FIG. 7 is a graphical representation comparing the performance of the apparatus of the invention with that of two previously-known types of apparatus.

FIG. 7 is a graph in which ordinates represent the percentage of drug released from the dosage unit which has been dissolved in the solvent and abscissae represent the time in minutes measured from the time when the dosage unit is immersed in the solvent and rotation started. In this figure, the solid-line curves A show dissolution as a function of time using the method and apparatus of the invention; the dashed-line curves B show the same function for the USP I apparatus and method, and the dash-dot lines C show this same function for the USP II apparatus and method.

All three curves were obtained by the same process, except for the apparatus used. As mentioned, Curve A was obtained using the apparatus of FIG. 1, Curve B resulted from using a #40 mesh basket in the USP I apparatus, rotated on and about the vertical shaft axis; and Curve C used the USP II arrangement in which the dosage unit is allowed to sink to the bottom of the beaker and agitation is by means of a rotating paddle.

In obtaining the curves of FIG. 7, the operating parameters were as follows:

A USP calibrator tablet was used, in each case constituting a 300-milligram dose, non-disintegrating tablet of salicylic acid. The solvent (dissolution medium) temperature was 37°±0.5° C. For the USP I and the USP II apparatus rotational speeds of 15, 30, 50 and 100 RPM were used. For the apparatus of the invention, the inner vertical shaft was held fixed, and the outer vertical shaft was rotated at the speeds of 15, 25, 35 and 50 RPM. Since the gear ratio was 1:1, the cylinder rotated about its own axis at these same speeds. Samples were taken by the USP standard methods and the solvent 20 was tested for its drug content. Rotation of the basket around the vertical axis was in a clockwise direction viewed from the top of the basket, and clockwise about the basket axis when viewed from the free end of the basket.

From the curves of FIG. 7 it can be seen that the rate of dissolution is higher at 50 RPM in the apparatus of the invention than it is at 100 RPM in the USP I and USP II apparatus, and much higher than when the USP I and USP II apparatus are used at 50 RPM. For example, in the USP I and II systems, the dissolution percentage after 30 minutes at 50 RPM was about 17% and 19% respectively, while when using the apparatus of the invention it was about 31%, at least about 60% faster.

The apparatus of the invention may be used in the dissolution of other dosage units, and may be operated at other speeds and in other directions of rotation. The angle and positions of the axes of rotation of the basket may also be varied substantially from those shown, while still obtaining advantage from the two-axis rotation.

Thus while the invention has been described with particular reference to specific embodiments thereof in the interest of complete definiteness, it may be embodied in a variety of forms diverse from those specifically shown and described, without departing from the spirit and scope of the invention.

What is claimed is:

1. Apparatus for accomplishing the dissolution of a pharmacologic dosage unit such as a pill, pellet, capsule or the like, in a solvent bath, comprising:

cylindrical basket means having an interior volume sufficiently greater than the volume of said dosage unit to permit said dosage unit to move freely in all directions within said basket means;

first means for orbiting said basket means in said solvent about a first axis outside said basket means and at right angles to the cylinder axis of said basket means; and second means for simultaneously spinning said basket means in said solvent about its cylinder axis.

2. Apparatus according to claim 1, wherein said first axis is substantially vertical and said cylinder axis is substantially horizontal.

3. The apparatus of claim 1, wherein said first means comprises a first shaft rotatable on said first axis and said second means comprises a second shaft rotatable on said cylinder axis 4. The apparatus of claim 3, wherein said second means comprises means coupling said first and second shafts to each other.

5. Apparatus according to claim 4, comprising first motor means for rotating said first shaft on said first axis, said coupling means comprising gear means for rotating said second shaft in response to rotation of said first shaft.

6. Apparatus according to claim 1, wherein said basket means comprises a woven mesh cylinder of chemically inert wire, having its cylinder axis substantially horizontal.

7. Apparatus according to claim 1, comprising a container for said solvent, said first axis extending substantially vertically near the center of said solvent container, said basket means being spaced substantially from all walls of said solvent container.

8. Apparatus for evaluation of dissolution behavior of dissoluble solid dosage forms by immersion of a solid dosage form in a dissolution medium, comprising a porous cylindrical basket for receiving the dosage in solid form, the basket pores allowing for the free circulation of the dissolution medium, means mounting said basket for spinning about its cylinder axis while immersed within the medium with said cylinder axis substantially horizontally extending; drive means comprising a substantially vertically extending drive shaft laterally offset from the basket; said drive means being interconnected with the basket for simultaneous orbital movement of the basket about the axis of the vertically extending drive shaft and spinning movement of said basket about said substantially horizontally extending axis.

9. Apparatus according to claim 8, wherein the drive means includes means rotatably interconnecting the vertically extending drive shaft and the basket for spinning the basket about said substantially horizontally extending axis.

10. Apparatus according to claim 9, wherein the drive means includes a first gear coaxially mounted on said vertically extending drive shaft and a second gear enmeshed with said first gear and mounted on said substantially horizontally extending axis; said second gear producing rotation of the basket about the horizontal axis upon rotation of the first gear.

* * * * *